US008070523B1

(12) United States Patent
Hsu

(10) Patent No.: US 8,070,523 B1
(45) Date of Patent: Dec. 6, 2011

(54) TRANSMISSION CABLE FOR A COMPUTER AND AN ELECTRONIC DEVICE

(75) Inventor: Ming-Yuan Hsu, Taipei (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/883,284

(22) Filed: Sep. 16, 2010

(30) Foreign Application Priority Data

Aug. 6, 2010 (TW) ..... 99126197 A

(51) Int. Cl.
*H01R 25/00* (2006.01)

(52) U.S. Cl. ..... 439/638

(58) Field of Classification Search ..... 439/502, 439/638; 342/357.1, 357.12, 357.13, 357.01, 342/357.06
See application file for complete search history.

(56) References Cited

U.S. PATENT DOCUMENTS 5,509,827 A * 4/1996 Huppenthal et al. ..... 439/638
5,921,816 A * 7/1999 Larabell ..... 439/638
6,007,372 A * 12/1999 Wood ..... 439/502
6,389,359 B1 * 5/2002 Potter et al. ..... 701/213
6,554,650 B2 * 4/2003 Kayworth et al. ..... 439/638
6,844,846 B1 * 1/2005 Riday ..... 342/357.52
6,857,899 B2 * 2/2005 Reed et al. ..... 439/497
6,909,907 B1 * 6/2005 Oyang et al. ..... 455/556.1
6,939,177 B2 * 9/2005 Kato et al. ..... 439/638
6,945,821 B2 * 9/2005 Stoner et al. ..... 439/638
7,040,918 B2 * 5/2006 Moriyama et al. ..... 439/497
7,151,950 B1 * 12/2006 Oyang et al. ..... 455/556.1
7,285,021 B2 * 10/2007 Bell et al. ..... 439/623
7,468,692 B1 * 12/2008 Wiegers ..... 342/357.51
7,541,776 B2 * 6/2009 Tupman et al. ..... 320/134
7,746,032 B2 * 6/2010 Tupman et al. ..... 320/132
2003/0112034 A1 * 6/2003 Li ..... 326/77
2003/0124903 A1 * 7/2003 Inagaki et al. ..... 439/502
2005/0191897 A1 * 9/2005 Kondou et al. ..... 439/497
2007/0210984 A1 * 9/2007 Choi et al. ..... 345/3.1
2008/0207061 A1 * 8/2008 Mukai et al. ..... 439/676
2008/0274631 A1 * 11/2008 Lee et al. ..... 439/78
2009/0196621 A1 * 8/2009 Chen ..... 398/115
2010/0197168 A1 * 8/2010 Deren et al. ..... 439/578
2010/0312930 A1 * 12/2010 Yamagata et al. ..... 710/67

* cited by examiner

*Primary Examiner* — Hae Moon Hyeon
*Assistant Examiner* — Vladimir Imas
(74) *Attorney, Agent, or Firm* — Altis Law Group, Inc.

(57) ABSTRACT

A transmission cable provides communication between a computer and an electronic device. The transmission cable includes a first plug and a second plug. The first plug connects with the electronic device. The second plug connects with the computer. The first plug includes a data receiving socket, a data transmission socket, and a grounding socket. The grounding socket is positioned between the data receiving socket and the data transmission socket. The second plug is a D-sub connector.

5 Claims, 3 Drawing Sheets

TRANSMISSION CABLE FOR A COMPUTER AND AN ELECTRONIC DEVICE

BACKGROUND

1. Technical Field

The present disclosure relates to a transmission cable providing communication between a computer and an electronic device.

2. Description of Related Art

A D-sub connector is often used for RS-232 serial communications, attached to a transmission cable, providing communication between a computer and an electronic device during a testing procedure. The D-sub connector includes a data receiving socket and a data transmission socket on specific locations of the D-sub connector.

A commonly used electronic device includes a data receiving pin and data transmission pin. The communication is effective when the data receiving socket electronically connects with the data transmission pin, and the data transmission socket electronically connects with the data receiving pin. If the data transmission pin and the data receiving pin of the electronic device do not correspond to the data receiving socket and the data transmission socket of the D-sub connector in connection, the communication between the electronic device and D-sub connector will be ineffective.

Therefore, there is room for improvement within the art.

BRIEF DESCRIPTION OF THE DRAWINGS

Many aspects of the present disclosure can be better understood with reference to the following drawings. The components in the various drawings are not necessarily drawn to scale, the emphasis instead being placed upon clearly illustrating the principles of the present disclosure. Moreover, in the drawings, like reference numerals designate corresponding parts throughout the figures.

DETAILED DESCRIPTION

Figure 1:
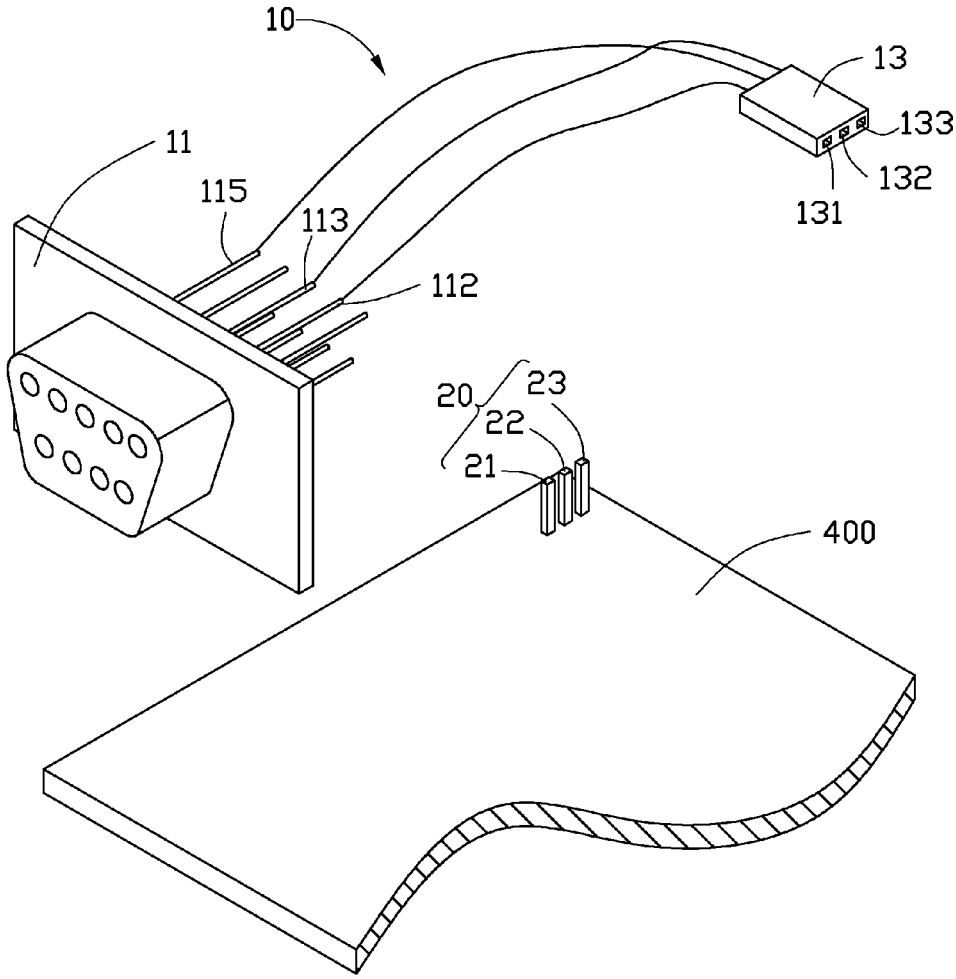
FIG. 1 is a perspective view of a transmission cable used with an electronic device.

FIG. 1 is a perspective view of a transmission cable 10 used with an electronic device 400. The transmission cable 10 includes a first plug 13 and a second plug 11. The first plug 13 includes a data receiving socket 131, a grounding socket 132, and a data transmission socket 133 arranged in a straight line. The grounding socket 132 is positioned between the receiving socket 131 and the data transmission socket 133, such that the data receiving socket 131 and the data transmission socket 133 keeps a same interval with respect to the grounding socket 132. In the exemplary embodiment, the second plug 11 is a D-sub connector for RS-232 serial communication. The second plug 11 includes a data receiving lead 112, a data transmission lead 113, and a grounding lead 115. The receiving socket 131 connects with the data receiving lead 112. The grounding socket 132 connects with the grounding lead 115. The data transmission socket 133 connects with the data transmission lead 113.

The transmission cable 10 is capable of connecting with an electronic device 400. The electronic device 400 may include a pin set 20 operable to connect with the transmission cable 10 for testing in a factory. The pin set 20 includes a first pin 21, a grounding pin 22, and a second pin 23. The grounding pin 22 is positioned between the first pin 21 and the second pin 23. The transmission cable 10 connects with the electronic device 400 by the first plug 13 receiving the pin set 20.

Figure 2:
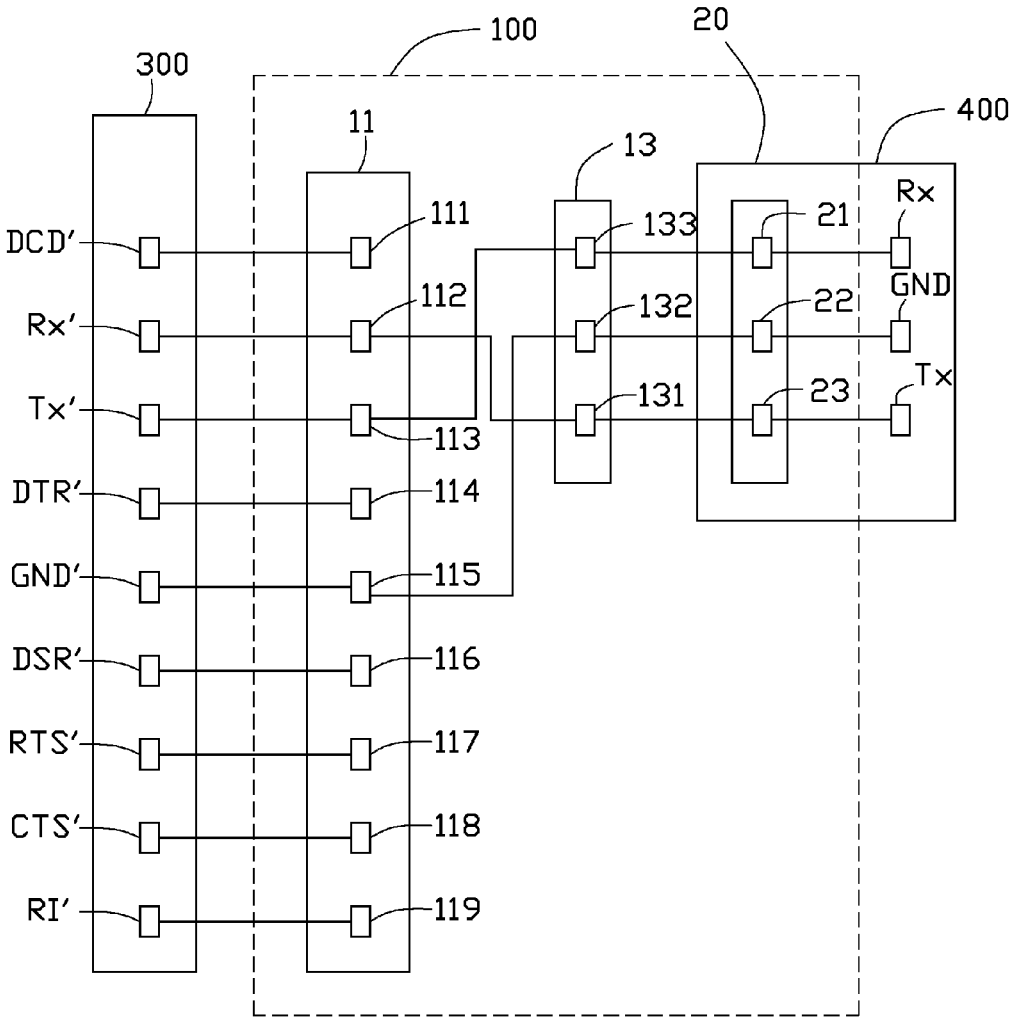
FIG. 2 is a block diagram of an electronic connection established by the transmission cable of FIG. 1 with a first state.

FIG. 2 is a block diagram of an electronic connection 100 established by the transmission cable 10 in a first state. A computer 300 may be in communication with the electronic device 400 through the electronic connection 100. The computer 300 includes a Data Carrier Detect (DCD) node DCD', a data receiving node Rx', a data transmission node Tx', a Data Terminal Ready (DTR) node DTR', a grounding node GND', a Data Set Ready (DSR) node DSR', a Request to Send (RTS) node RTS', a Clear to Send (CTS) node CTS', and a Ring Indicator (RI) node RI'.

The second plug 11 further includes a DCD lead 111, a DTR lead 114, a DSR lead 116, a RTS lead 117, a CTS lead 118, and a RI lead 119. The DCD lead 111 electronically connects with the DCD node DCD'. The data receiving lead 112 electronically connects with the data receiving node Rx'. The data transmission lead 113 electronically connects with the data transmission node Tx'. The DTR lead 114 electronically connects with the DTR node DTR'. The grounding lead 115 electronically connects with the grounding node GND'. The DSR lead 116 electronically connects with the DSR node DSR'. The RTS lead 117 electronically connects with the RTS node RTS'. The CTS lead 118 electronically connects with the CTS node CTS'. The RI lead 119 electronically connects with the RI node RI'.

The electronic device 400 further includes a data receiving node Rx, a grounding node GND, and a data transmission node Tx. In the exemplary embodiment, the first pin 21 electronically connects with the data receiving node Rx, the grounding pin 22 electronically connects with the grounding node GND, and the second pin 23 electronically connects with the data transmission node Tx. The first plug 13 may be operated to have the receiving socket 131 receive the second pin 23, the grounding socket 132 receive the grounding pin 22, and the data transmission socket 133 receive the first pin 21. The receiving socket 131 may electronically connect with the data transmission node Tx through the second pin 23. The data transmission socket 133 may electronically connect with the data receiving node Rx through the first pin 21. As a result, the electronic connection 100 is effective, and therefore the computer 300 may be in communication with the electronic device 400.

Figure 3:
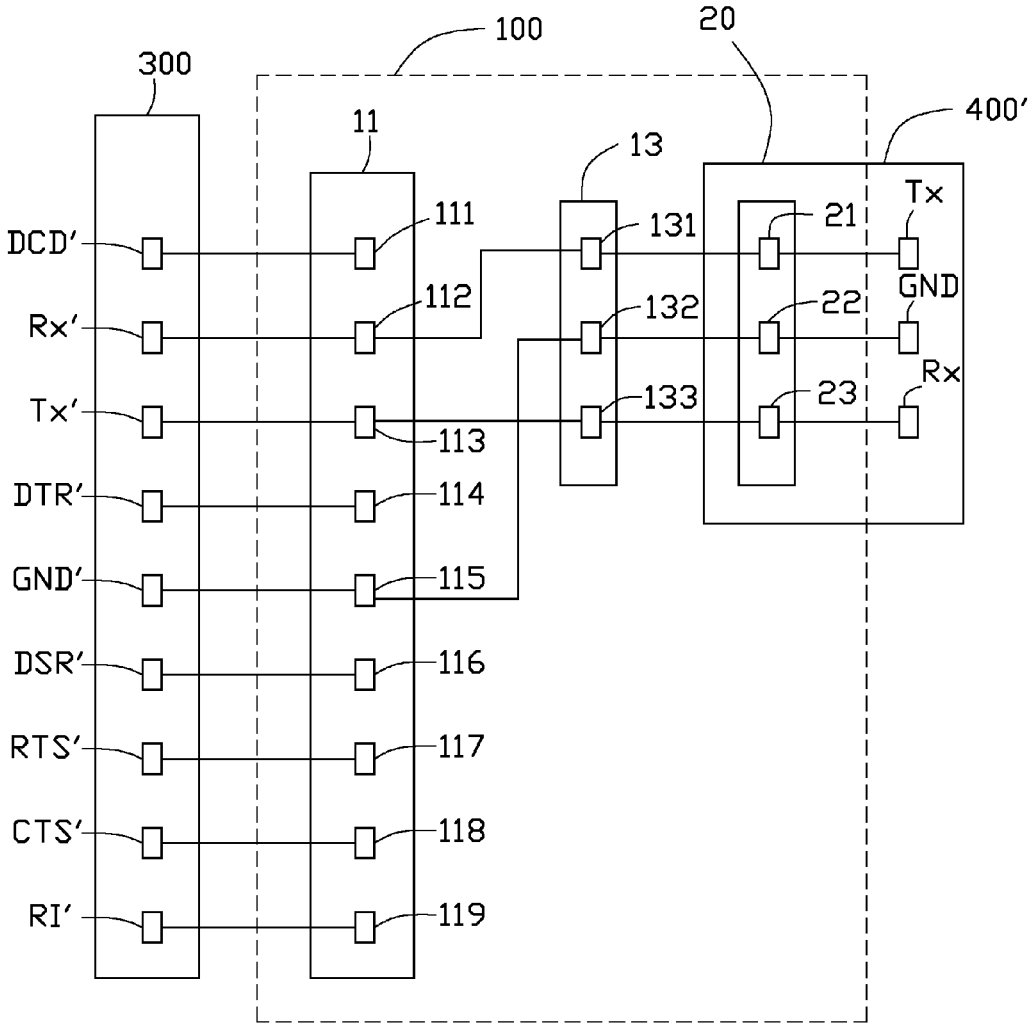
FIG. 3 is a block diagram of an electronic connection established by the transmission cable of FIG. 1 with a second state.

FIG. 3 is a block diagram of the electronic connection 100 established by the transmission cable 10 in a second state. The computer 300 may be in communication with an electronic device 400' through the electronic connection 100. The electronic device 400' also includes the pin set 20, the data receiving node Rx, the grounding node GND, and the data transmission node Tx. Differing from the electronic device 400, an arrangement of the data receiving node Rx and the data transmission node Tx of the electronic device 400' is opposite to those of the electronic device 400.

In the exemplary embodiment, the first pin 21 electronically connects with the data transmission node Tx, the grounding pin 22 electronically connects with the grounding node GND, and the second pin 23 electronically connects with the data receiving node Rx. Differing from FIG. 2, the first plug 13 may be reversed to have the receiving socket 131 receive the first pin 21, the grounding socket 132 receive the grounding pin 22, and the data transmission socket 133 receive the second pin 23. The receiving socket 131 may electronically connect with the data transmission node Tx through the first pin 21. The data transmission socket 133 may electronically connect with the data receiving node Rx through the second pin 23. As a result, the electronic connection 100 is effective, and therefore the computer 300 may be in communication with the electronic device 400'.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A transmission cable capable of providing communication between a computer and an electronic device, the transmission cable comprising:

a first plug operable to connect with the electronic device;

a second plug operable to connect with the computer; and a cable body connected between the first plug and the second plug;

wherein the second plug being a D-sub connector corresponding to RS-232 serial communication standard includes a data receiving lead, a data transmission lead, and a grounding lead, the first plug includes a data receiving socket, a data transmission socket, and a grounding socket respectively corresponding to the data receiving lead, the data transmission lead, and the grounding lead of the second plug, wherein the grounding socket is positioned between the data receiving socket and the data transmission socket such that the data receiving socket, the grounding socket, and the data transmission socket substantially arranged in a straight line, and the data receiving socket and the data transmission socket substantially keep a same interval with respect to the grounding socket.

2. The transmission cable of claim 1, wherein the electronic device includes a data receiving pin, a data transmission pin, and a grounding pin positioned between the data receiving pin and the data transmission pin, the data receiving socket receives the data transmission pin.

3. The transmission cable of claim 1, wherein the electronic device includes a data receiving pin, a data transmission pin, and a grounding pin positioned between the data receiving pin and the data transmission pin, the data transmission socket receives the data receiving pin.

4. The transmission cable of claim 1, wherein the electronic device includes a data receiving pin, a data transmission pin, and a grounding pin positioned between the data receiving pin and the data transmission pin, the grounding socket receives the grounding pin.

5. The transmission cable of claim 1, wherein the D-sub connector is female.

* * * * *